US010365592B2

(12) United States Patent
Nagamori et al.

(10) Patent No.: US 10,365,592 B2
(45) Date of Patent: Jul. 30, 2019

(54) IMAGE FORMING APPARATUS WITH PASSIVELY ROTATING FIXING DEVICE

(71) Applicant: FUJI XEROX CO., LTD., Tokyo (JP)

(72) Inventors: Yuki Nagamori, Kanagawa (JP); Mitsuhiro Matsumoto, Kanagawa (JP); Kunihiko Sato, Kanagawa (JP); Kosuke Yamada, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 16/004,593

(22) Filed: Jun. 11, 2018

(65) Prior Publication Data

US 2019/0121272 A1 Apr. 25, 2019

(30) Foreign Application Priority Data

Oct. 25, 2017 (JP) ..... 2017-206582

(51) Int. Cl.
*G03G 15/00* (2006.01)
*G03G 15/20* (2006.01)

(52) U.S. Cl.
CPC ..... *G03G 15/2028* (2013.01); *G03G 15/6573* (2013.01)

(58) Field of Classification Search
CPC ..... G03G 15/2028; G03G 15/2032; G03G 15/6517; G03G 15/652; G03G 15/657; G03G 15/6573
See application file for complete search history.

(56) References Cited

U.S. PATENT DOCUMENTS

| | | | | |
|---|---|---|---|---|
| 7,382,995 | B2 | 6/2008 | Itoh et al. | |
| 9,690,239 | B2 | 6/2017 | Ui et al. | |
| 2003/0039497 | A1* | 2/2003 | Shimoyama | G03G 15/6517 399/384 |
| 2017/0308012 | A1* | 10/2017 | Kibayashi | G03G 15/2032 |
| 2017/0357196 | A1* | 12/2017 | Tanaka | G03G 15/652 |
| 2018/0011436 | A1* | 1/2018 | Sato | G03G 15/652 |

FOREIGN PATENT DOCUMENTS

| | | | |
|---|---|---|---|
| JP | 2007-057827 | A | 3/2007 |
| JP | 2016-173420 | A | 9/2016 |
| JP | 2016-180925 | A | 10/2016 |

* cited by examiner

*Primary Examiner* — Sophia S Chen
(74) *Attorney, Agent, or Firm* — Sughrue Mion, PLLC

(57) ABSTRACT

An image forming apparatus includes an image carrier, a transfer member that transfers an image on the image carrier to a continuous medium, a fixing device that fixes the image transferred to the medium, and a transport member that is disposed downstream of the fixing device in a transport direction of the medium and that transports the medium. When the transport member transports the medium, the fixing device is passively rotated in accordance with movement of the medium.

8 Claims, 9 Drawing Sheets

IMAGE FORMING APPARATUS WITH PASSIVELY ROTATING FIXING DEVICE

CROSS-REFERENCE TO RELATED APPLICATIONS

This application is based on and claims priority under 35 USC 119 from Japanese Patent Application No. 2017-206582 filed Oct. 25, 2017.

BACKGROUND

Technical Field

The present invention relates to an image forming apparatus.

SUMMARY

According to an aspect of the invention, an image forming apparatus includes an image carrier, a transfer member that transfers an image on the image carrier to a continuous medium, a fixing device that fixes the image transferred to the medium, and a transport member that is disposed downstream of the fixing device in a transport direction of the medium and that transports the medium. When the transport member transports the medium, the fixing device is passively rotated in accordance with movement of the medium.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the invention will be described with reference to the drawings. Note that the present invention is not limited to the exemplary embodiment described below.

To facilitate understanding the following description, the directions in the figures are defined as follows: the front-back direction is the X-axis direction, the left-right direction is the Y-axis direction, and the up-down direction is the Z-axis direction. The directions indicated by arrows X, −X, Y, −Y, Z, and −Z are respectively defined as forward, backward, rightward, leftward, upward, and downward; or the front side, the back side, the right side, the left side, the upper side, and the lower side.

In each of the figures, a symbol "○" with "•" in it represents an arrow extending from the back side toward the front side of the plane of the figure, and a symbol "○" with "x" in it represents an arrow extending from the front side toward the back side of the plane of the figure.

In the figures, members that are unnecessary for understanding the following descriptions may not be illustrated.

Exemplary Embodiment

Figure 1:
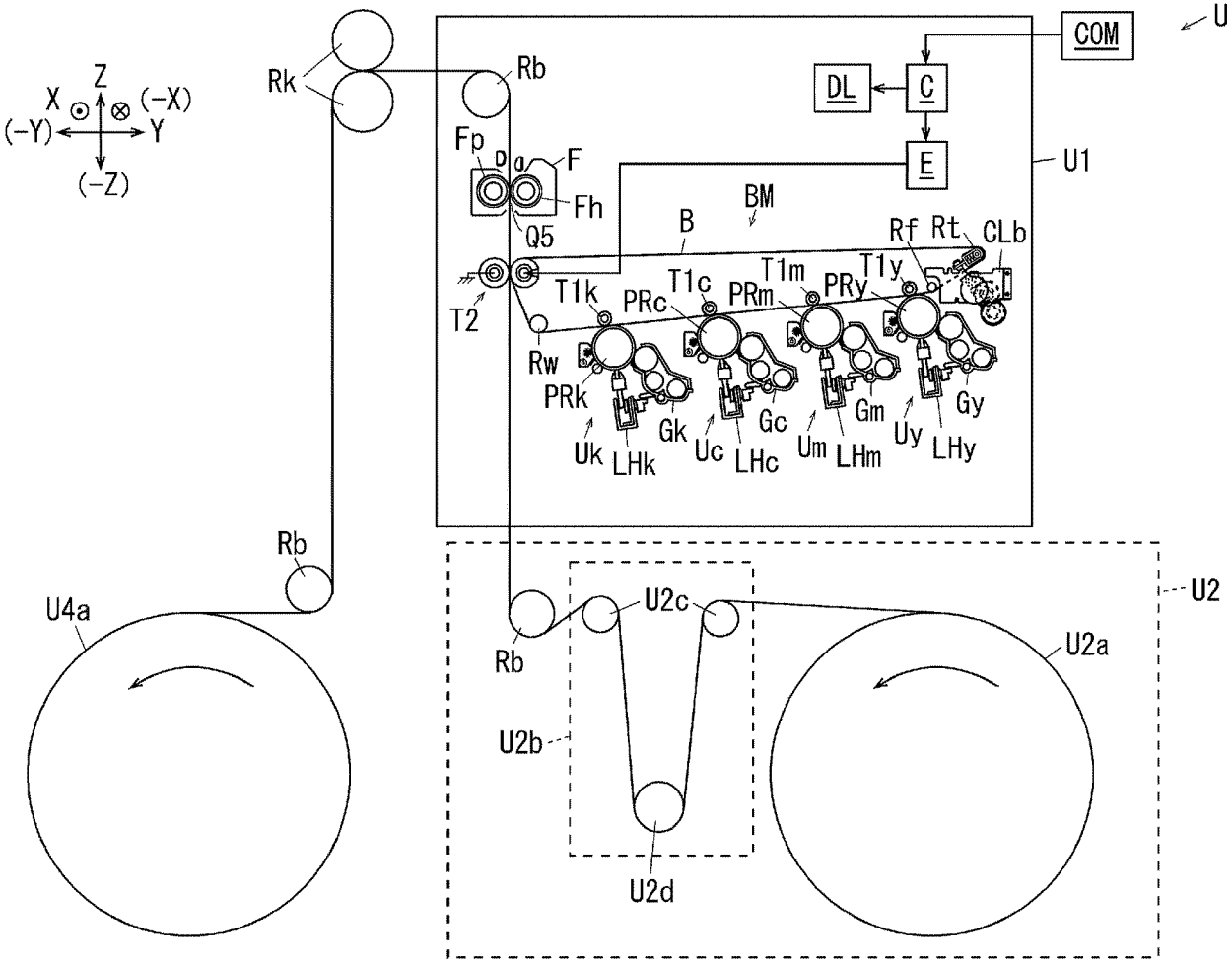
FIG. 1 is an overall view of an image forming apparatus according to the exemplary embodiment.

FIG. 1 is an overall view of an image forming apparatus according to an exemplary embodiment.

Figure 2:
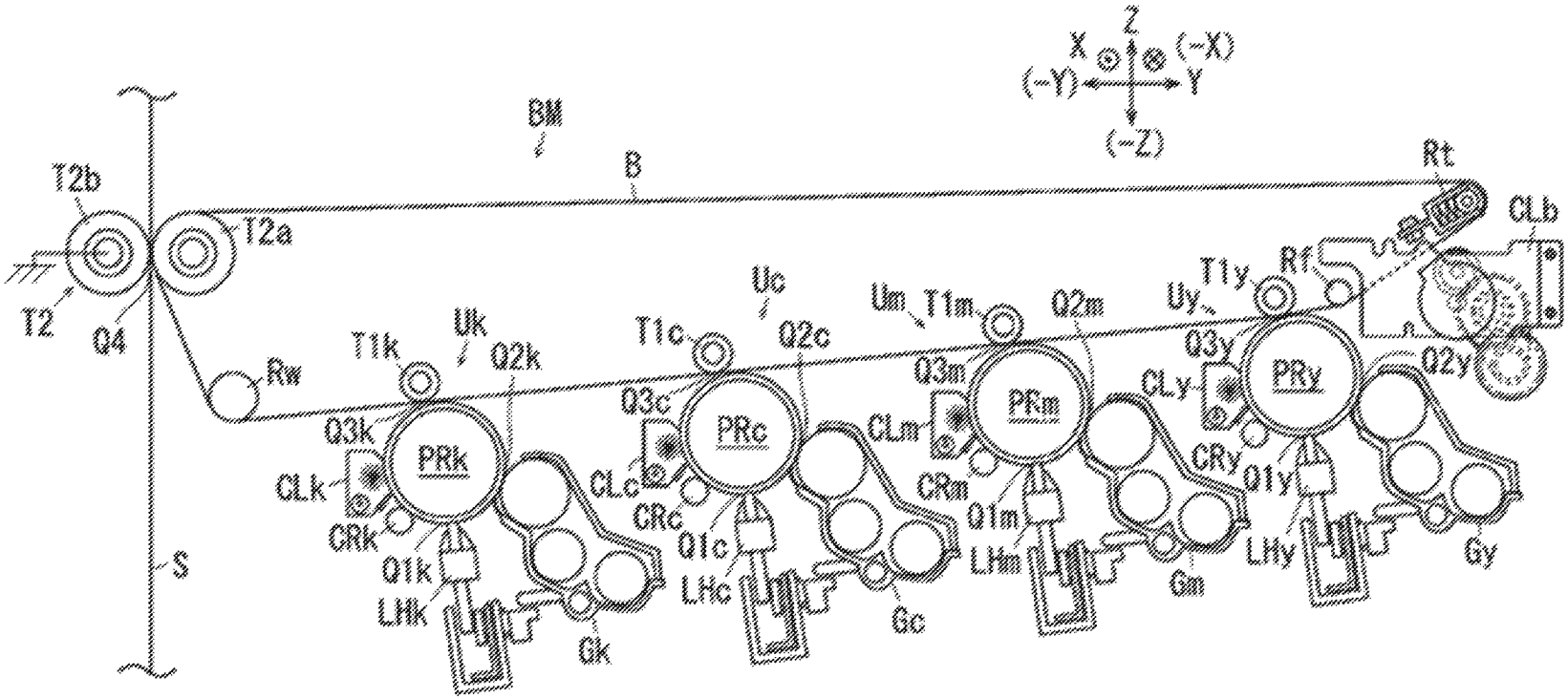
FIG. 2 is a partial view of the image forming apparatus according to the exemplary embodiment.

FIG. 2 is a partial view of the image forming apparatus according to the exemplary embodiment.

Referring to FIG. 1, a printer U, which is an example of an image forming apparatus according to the exemplary embodiment of the present invention, includes a printer body U1, which is an example of a recording unit and an example of an image forming unit. The printer body U1 includes a controller C that controls the printer U. The controller C is electrically connected to a personal computer COM, which is an example of information transmitting device. The controller C is capable of processing image information transmitted from the personal computer COM. The controller C is electrically connected to a writing circuit DL of the printer body U1. Referring to FIGS. 1 and 2, the writing circuit DL is electrically connected to LED heads LHy, LHm, LHc, and LHk, each of which is an example of a latent-image forming device and an example of an exposure device.

The LED heads LHy, LHm, LHc, and LHk according to the exemplary embodiment are disposed so as to correspond to yellow (Y), magenta (M), cyan (C), and black (K). The LED heads LHy to LHk according to the exemplary embodiment each include an LED array, which is an example of a light-emitting element and in which LEDs are arranged linearly in the width direction of an image. The LEDs of the LED heads LHy to LHk are each capable of emitting light in accordance with an input signal. That is, the LED heads LHy to LHk are each capable of outputting a writing beam in accordance with an input signal.

Referring to FIGS. 1 and 2, photoconductors PRy, PRm, PRc, and PRk, each of which is an example of an image carrier, are disposed above the LED heads LHy to LHk. The photoconductors PRy to PRk and the LED heads LHy to LHk face each other in writing regions Q1*y*, Q1*m*, Q1*c*, and Q1*k*.

Charging rollers CRy, CRm, CRc, and CRk, each of which is an example of a charger, are disposed upstream of the LED heads LHy to LHk in the rotation direction of the photoconductors PRy, PRm, PRc, and PRk. The charging rollers CRy to CRk according to the exemplary embodiment are supported so as to be rotatable in contact with the photoconductors PRy to PRk.

Developing devices Gy, Gm, Gc, and Gk are disposed downstream of the LED heads LHy to LHk in the rotation direction of the photoconductors PRy to PRk. The photoconductors PRy to PRk and the developing devices Gy to Gk face each other in developing regions Q2*y*, Q2*m*, Q2*c*, and Q2*k*.

First-transfer rollers T1*y*, T1*m*, T1*c*, and T1*k*, each of which is an example of a first-transfer unit, are disposed downstream of the developing devices Gy to Gk in the rotation direction of the photoconductors PRy to PRk. The photoconductors PRy to PRk and the first-transfer rollers T1*y* to T1*k* face each other in the first-transfer regions Q3*y*, Q3*m*, Q3*c*, and Q3*k*.

Photoconductor cleaners CLy, CLm, CLc, and CLk, each of which is an example of an image carrier cleaner, are disposed downstream of the first-transfer rollers T1*y* to T1*k* in the rotation direction of the photoconductors PRy to PRk.

The photoconductor PRy, the charging roller CRy, the LED head LHy, the developing device Gy, the first-transfer roller T1*y*, the photoconductor cleaner CLy, each for the color Y, constitute an image-forming unit Uy for the color Y according to the exemplary embodiment. The image-forming unit Uy (an example of a yellow-visible-image forming device) forms a toner image of the color Y as an example of a visible image. Likewise, the photoconductors PRm, PRc, and PRk; the charging roller CRm, CRc, and CRk; the LED heads LHm, LHc, and LHk; the developing devices Gm, Gc, and Gk; the first-transfer rollers T1*m*, T1*c*, and T1*k*; and the photoconductor cleaners CLm, CLc, and CLk respectively constitute image-forming units Um, Uc, and Uk for the colors M, C, and K.

A belt module BM, which is an example of an intermediate transfer device, is disposed above the photoconductors PRy to PRk. The belt module BM includes an intermediate transfer belt B, which is an example of an image carrier and an example of an intermediate transfer body. The intermediate transfer belt B is an endless-belt-shaped member.

The intermediate transfer belt B according to the exemplary embodiment is rotatably supported by a tension roller Rt, which is an example of a tension member; a walking roller Rw, which is an example of a deviation correction member; an idler roller Rf, which is an example of a driven member; a backup roller T2*a*, which is an example of a second-transfer-region facing member and an example of a drive member; and the first-transfer rollers T1*y*, T1*m*, T1*c*, and T1*k*.

A second-transfer roller T2*b*, which is an example of a second-transfer member, is disposed so as to face the backup roller T2*a* with the intermediate transfer belt B therebetween. In the exemplary embodiment, a power circuit E applies a second-transfer voltage, having the same polarity as the charged toner, to the backup roller T2*a*. The second-transfer roller T2*b* is grounded. The backup roller T2*a* and the second-transfer roller T2*b* constitute a second-transfer unit T2 according to the exemplary embodiment. The second-transfer roller T2*b* and the intermediate transfer belt B are in contact with each other in a second-transfer region Q4.

A belt cleaner CLb, which is an example of an intermediate-transfer-body cleaner, is disposed downstream of the second-transfer region Q4 in the rotation direction of the intermediate transfer belt B.

The first-transfer rollers T1*y* to T1*k*, the intermediate transfer belt B, the second-transfer unit T2, and the like constitute a transfer device T1+T2+B according to the exemplary embodiment.

Referring to FIG. 1, a sheet feeding device U2, which is an example of a sheet feeding unit, is disposed below the image-forming units Uy to Uk. The sheet feeding device U2 includes a sheet feeding member U2*a* around which a continuous sheet S, which is an example of a continuous medium, is wound. The sheet feeding member U2*a* is rotatably supported. A tension application unit U2*b*, which is an example of a tension application device, is disposed on the left side of the sheet feeding member U2*a*. The tension application unit U2*b* includes two driven rollers U2*c*, each of which is an example of a support member, for supporting the continuous sheet S. A tension roller U2*d*, which is an example of a tension application member, is disposed between the driven rollers U2*c*. The tension roller U2*d* is in contact with the continuous sheet S and supported so as to be movable in the up-down direction. The tension roller U2*d* presses the continuous sheet S with gravity to apply a tension to the continuous sheet S, thereby preventing creasing of the continuous sheet S.

The continuous sheet S from the sheet feeding device U2 passes through the second-transfer region Q4 of the printer body U1.

A fixing device F is disposed downstream of the second-transfer roller T2*b* in the transport direction of the continuous sheet S. The fixing device F includes a heating belt Fh, which is an example of a first fixing member, and a pressing roller Fp, which is an example of a second fixing member.

A guide roller Rb, which is an example of a guide member, is rotatably supported at a position downstream of the fixing device F.

A traction roller Rk, which is an example of a medium transport member and a traction member, is disposed downstream of the guide roller Rb. The traction roller Rk according to the exemplary embodiment is composed a pair of rollers that nip the continuous sheet S. The traction roller Rk is rotated by a motor (not shown), which is an example of a drive source, and transports the continuous sheet S downstream.

A guide roller Rb, which is an example of a guide member, is disposed downstream of the traction roller Rk.

A winding roller U4*a*, which is an example of a recovery member, is disposed downstream of the guide roller Rb. The continuous sheet S is wound around the winding roller U4*a*. The winding roller U4*a* is driven by a motor (not shown), which is an example of a drive source.

Description of Image Forming Operation

When receiving image information from the personal computer COM, the printer U according to the exemplary embodiment, having the structure described above, starts a printing operation. On the basis of the received image information, the controller C causes the printer U to generate image information for forming latent images of yellow Y, magenta M, cyan C, and black K. The controller C outputs the generated image information to the writing circuit DL of the printer body U1. If the image is a monochrome image, the controller C outputs the image information for forming only a black (K) image to the writing circuit DL.

The writing circuit DL outputs control signals to the LED heads LHy to LHk in accordance with the input image information. The LED heads LHy to LHk output writing beams in accordance with the control signals.

The photoconductors PRy to PRk rotate when the image forming operation is started. The power circuit E applies a charging voltage to the charging rollers CRy to CRk. Accordingly, the surfaces of the photoconductors PRy to PRk are charged by the charging rollers CRy to CRk. In the writing regions Q1*y* to Q1*k*, electrostatic latent images are formed on the surfaces of the photoconductors PRy to PRk as the LED heads LHy to LHk emit writing beams. In the developing regions Q2*y* to Q2*k*, the developing devices Gy, Gm, Gc, and Gk develop the electrostatic latent images on the photoconductors PRy to PRk into toner images, each of which is an example of a visible image.

The developed toner images are transported to the first-transfer regions Q3*y*, Q3*m*, Q3*c*, and Q3*k*, in which the photoconductors PRy to PRk are in contact with the intermediate transfer belt B. In the first-transfer regions Q3*y*, Q3*m*, Q3*c*, and Q3*k*, the power circuit E applies a first-transfer voltage, which has a polarity opposite to the charging polarity of the toner, to the first-transfer rollers T1*y* to T1*k*. Accordingly, the first-transfer rollers T1*y* to T1*k* transfer the toner images on the photoconductors PRy to PRk to the intermediate transfer belt B. When transferring multiple-color toner images to the intermediate transfer belt B, the toner images are transferred in such a way that a toner image is transferred in a first-transfer region on the downstream side so as to overlap a toner image that has been transferred in a first-transfer region on the upstream side.

The photoconductor cleaners CLy to CLk clean the surfaces of the photoconductors PRy to PRk by removing substances that remain on or adhere to the surfaces after first-transfer has been finished. The charging rollers CRy to CRk charge the cleaned surfaces of the photoconductors PRy to PRk again.

A monochrome toner image or multiple-color toner images, which has or have been transferred by the first-transfer rollers T1*y* to T1*k* onto the intermediate transfer belt B in the first-transfer regions Q3*y* to Q3*k*, are transported to the second-transfer region Q4.

The continuous sheet S is transported downstream by receiving transport forces in the second-transfer region Q4, from the fixing device F, and from the winding roller U4*a*.

The power circuit E applies a second-transfer voltage, which has the same polarity as the charged toner, to the backup roller T2*a*. Accordingly, the toner images on the intermediate transfer belt B are transferred from the intermediate transfer belt B to the continuous sheet S.

The belt cleaner CLb removes substances adhering to the surface of the intermediate transfer belt B after the second transfer.

When the continuous sheet S, to which toner images have been second-transferred, passes through a fixing region Q5, the toner images are heated and fixed to the continuous sheet S.

The continuous sheet S, to which has the images have been fixed, is wound around the winding roller U4*a*.

Description of Fixing Device F

Figure 3:
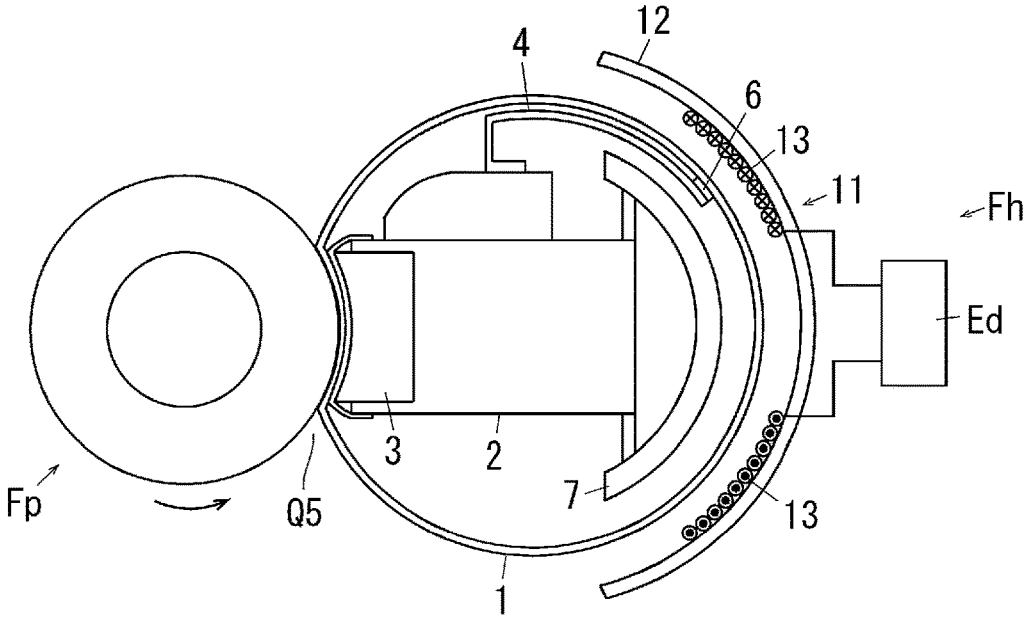
FIG. 3 illustrates a fixing device according to the exemplary embodiment.

FIG. 3 illustrates the fixing device F according to the exemplary embodiment.

Referring to FIG. 3, in the fixing device F according to the exemplary embodiment, a heating belt Fh, which is an example of a first fixing member, has a belt body 1, which is an example of an endless member. The belt body 1 is an endless belt that has a width larger than the width of the continuous sheet S. The belt body 1 has a multilayer structure including a base layer, an electroconductive layer (heat-generating layer), an elastic layer, a surface layer, and the like.

A pad support member 2, which is an example of a support body, is disposed in the belt body 1. The pad support member 2 has a bar-like shape extending in the width direction of the belt.

A pressing pad 3, which is an example of a pressing member, is supported by a part of the pad support member 2 facing the fixing region Q5. A thermistor 6, which is an example of a temperature detection member, is supported by the pad support member 2 via a spring portion 4, which is an example of an elastic portion. The thermistor 6 is in contact with the inner surface of the belt body 1 and is capable of detecting the temperature of the belt body 1.

A ferrite member 7, which is an example of a magnetic member, is supported by a part of the pad support member 2 facing away from the fixing region Q5. The ferrite member 7 has a shape that is curved along the inner peripheral surface of the belt body 1.

An induction heating unit 11, which is an example of a heat source, is disposed on a side of the belt body 1 opposite to a side where the fixing region Q5 is located. The induction heating unit 11 includes a base 12 that has a shape surrounding the belt body 1. An excitation coil 13, which is an example of an induction heater body, is supported by the base 12. A high-frequency electric current is supplied to the excitation coil 13 from an excitation circuit Ed, which is an example of a fixing power circuit. Accordingly, the electroconductive layer (heat-generating layer) of the belt body 1 generates heat due to a high-frequency magnetic field generated by the excitation coil 13. Thus, heat is applied to the continuous sheet S passing through the fixing region Q5.

Further detailed descriptions of the fixing device F will be omitted, because an induction-heating fixing device of this type is described, for example, in Japanese Unexamined Patent Application Publication No. 2007-57827 and known.

Figure 4:
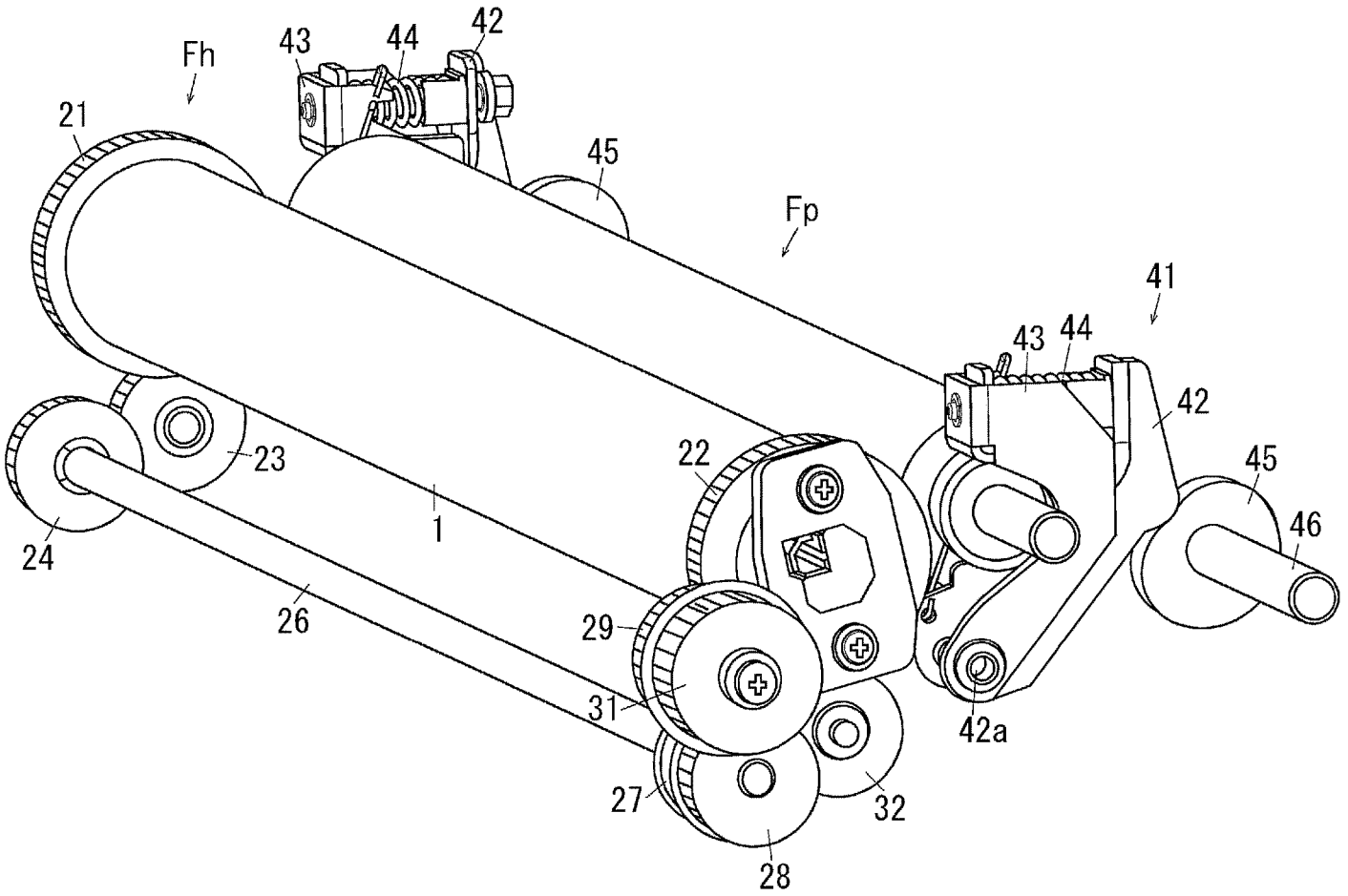
FIG. 4 is a perspective view of the fixing device according to the exemplary embodiment in a state in which a pressing roller is separated from a heating belt.

FIG. 4 is a perspective view of the fixing device F according to the exemplary embodiment in a state in which the pressing roller Fp is separated from the heating belt Fh.

Figure 5:
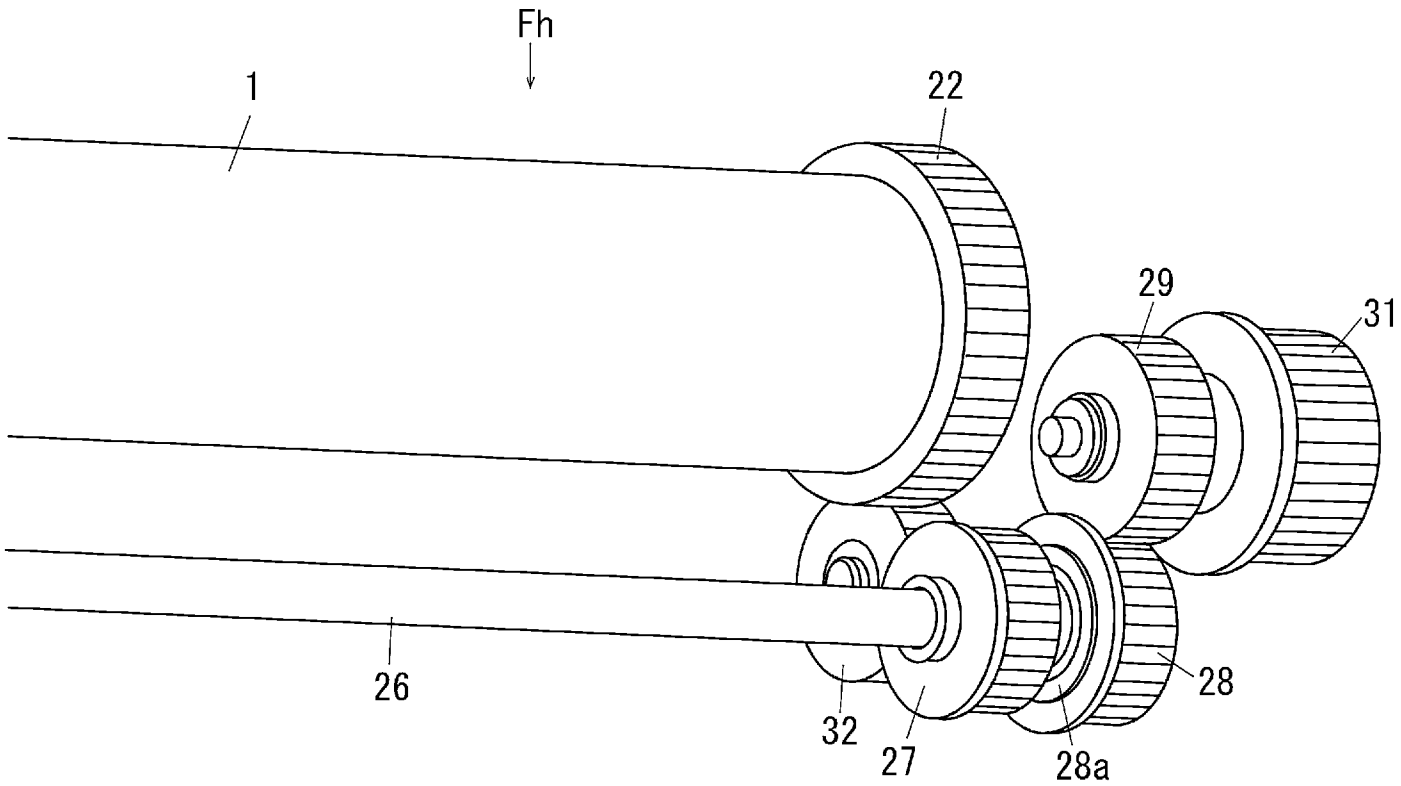
FIG. 5 is a partial view illustrating a rear part of the heating belt according to the exemplary embodiment.

FIG. 5 is a partial view illustrating a rear part of the heating belt Fh according to the exemplary embodiment.

Referring to FIGS. 4 and 5, in the fixing device F according to the exemplary embodiment, front and back belt gears 21 and 22, which are examples of a drive transmission member, are supported at both ends of the heating belt Fh in the axial direction. In the exemplary embodiment, the front belt gear 21 is bonded to the belt body 1. In contrast, the back belt gear 22 is not bonded to the belt body 1 but is supported by only being fitted to the belt body 1.

A first intermediate gear 23, which is an example of a drive transmitting member, meshes with the front belt gear 21.

A second intermediate gear 24, which is an example of a drive transmitting member, meshes with the first intermediate gear 23.

A rotary shaft 26 of the second intermediate gear 24 extends in the front-back direction.

Referring to FIG. 5, a third intermediate gear 27, which is an example of a drive transmitting member, is supported at the back end of the rotary shaft 26.

A fourth intermediate gear 28, which is an example of a drive transmitting member, is supported at a position on the rotary shaft 26 behind the third intermediate gear 27. A one-way clutch 28*a*, which is an example of a single-direction drive transmitting member, is disposed in the fourth intermediate gear 28 according to the exemplary embodiment.

Referring to FIGS. 4 and 5, a fifth intermediate gear 29, which is an example of a drive transmitting member, meshes with the fourth intermediate gear 28.

An input gear 31, which is an example of a drive input member, is supported coaxially with the fifth intermediate gear 29. Driving power is transmitted to the input gear 31 from a fixing motor (not shown), which is an example of drive source.

Referring to FIG. 5, a sixth intermediate gear 32, which is an example of a drive transmitting member, meshes with the third intermediate gear 27. The sixth intermediate gear 32 meshes with the back belt gear 22.

Accordingly, when driving power is transmitted to the input gear 31, the belt body 1 is rotated via the fifth intermediate gear 29, the fourth intermediate gear 28, the rotary shaft 26, the second intermediate gear 24, the first intermediate gear 23, and the front belt gear 21. At this time, the back belt gear 22 is rotated via the rotary shaft 26, the third intermediate gear 27, and the sixth intermediate gear 32. Although the back belt gear 22 does not transmit driving power to the belt body 1, if the back belt gear 22 is not provided and the belt body 1 is supported by a bearing, driving power is transmitted to only a front part of the belt body 1, and the bearing on the back side resists rotation. In this state, a rotation-speed difference occurs between the front and back ends of the belt body 1, and twisting of the belt body 1 may occur. On the other hand, if the front and back belt gears 21 and 22 are bonded to both ends of the belt body 1, irregular rotation may occur at both ends of the belt body 1 due to irregular rotation of the belt gears 21 and 22, irregular rotation of the intermediate gears 23 to 32 during transmission of driving power, or the like. Accordingly, in the exemplary embodiment, twisting of the belt is suppressed by transmitting driving power to the belt body 1 from the front belt gear 21, transmitting driving power to the back belt gear 22, and not transmitting the driving power from the back belt gear 22 to the belt body 1. In the exemplary embodiment, friction between the belt body 1 and the back belt gear 22, which occurs if the back belt gear 22 does not rotate, is also suppressed.

Figure 6:
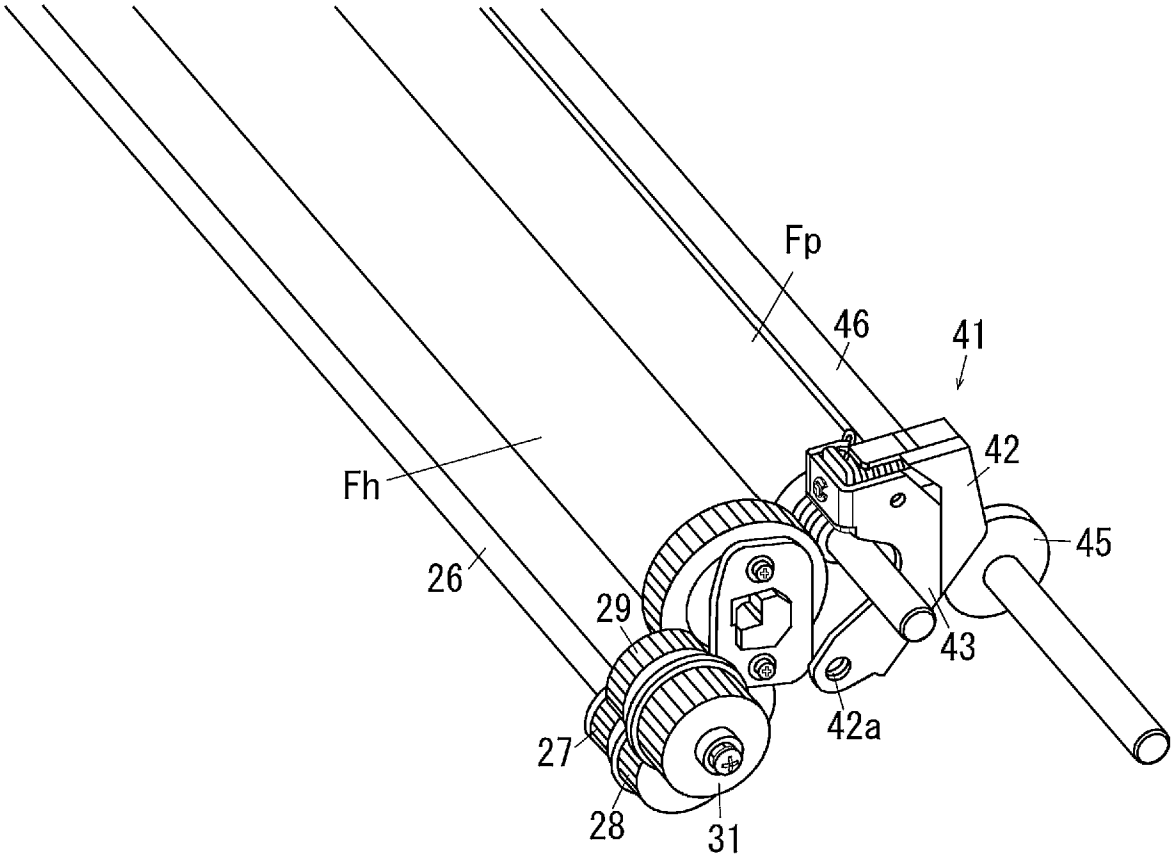
FIG. 6 is a perspective view of the fixing device according to the exemplary embodiment in a state in which the pressing roller is in contact with the heating belt.

FIG. 6 is a perspective view of the fixing device F according to the exemplary embodiment in a state in which the pressing roller Fp is in contact with the heating belt Fh.

Referring to FIGS. 4 and 6, the pressing roller Fp, which is an example of a second fixing member according to the exemplary embodiment, is supported by a latch mechanism 41, which is an example of a contact/separation mechanism. The latch mechanism 41 includes a pair of movable arms 42, which are examples of a movable member. The movable arms 42 are disposed at front and back positions and supported by a frame (not shown) of the fixing device F so as to be rotatable around pivots 42*a*. Pressing arms 43, which are examples of an urging support member, are supported by the pivots 42*a* of the movable arms 42. The pressing arms 43 are supported by the movable arms 42 so as to be rotatable around the pivots 42*a*.

Coil springs 44, which are examples of an urging member, are supported between the movable arms 42 and the pressing arms 43. Axial end portions of the pressing roller Fp are rotatably supported by the pressing arms 43. A pair of eccentric cams 45, which are examples of an operation member, are disposed at positions leftward and below the movable arms 42. The eccentric cams 45 are disposed at front and back positions so as to correspond to the front and back movable arms 42. The front and back eccentric cams 45 are supported by a rotary shaft 46 extending in the front-back direction. Driving power is transmitted to the rotary shaft 46 from a contact/separation motor (not shown), which is an example of a drive source.

Accordingly, as the eccentric cams 45 rotate, the movable arms 42 and the pressing arms 43 move around the pivots 42*a*, and thereby the pressing roller Fp move in directions such that the pressing roller Fp contacts and separates from the heating belt Fh. In a state in which the movable arms 42 and the pressing arms 43 have moved to the contact position, the pressing roller Fp is pressed against the heating belt Fh by the coil springs 44. It is possible to adjust the amount of movement of the movable arms 42 and the pressing arms 43 by adjusting the rotation positions of the eccentric cams 45. Accordingly, it is possible to adjust a force (fixing pressure) with which the pressing roller Fp is pressed against the heating belt Fh. Thus, when the eccentric cams 45 are stopped so that maximum-outside-diameter positions on the eccentric cams 45 contact the movable arms 42, the fixing pressure is the maximum; and the fixing pressure decreases as the distance (outside diameter) between the rotary shaft 46 and the positions on the eccentric cams 45 where the eccentric cams 45 contact the movable arms 42 decreases.

Figure 7:
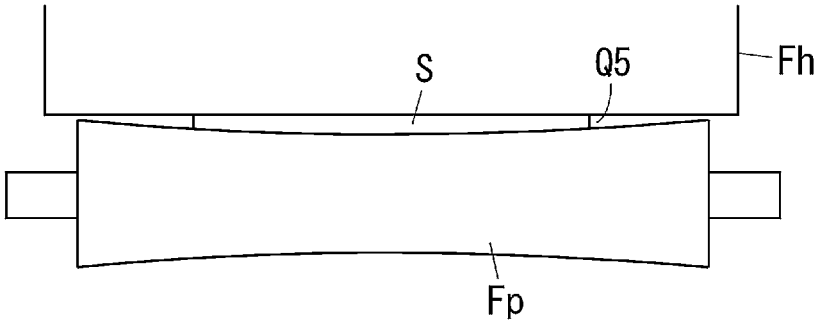
FIG. 7 illustrates the pressing roller according to the exemplary embodiment as seen in a direction perpendicular to the axial direction.

FIG. 7 illustrates the pressing roller Fp according to the exemplary embodiment as seen in a direction perpendicular to the axial direction.

Referring to FIG. 7, the pressing roller Fp according to the exemplary embodiment has a roll shape (substantially cylindrical shape) having an outside diameter that is small at a middle portion thereof in the axial direction and that increases toward each end portion thereof in the axial direction. That is, the pressing roller Fp according to the exemplary embodiment has a so-called flared or bobbin-like shape. Accordingly, the peripheral speed of each end portion of the surface of the pressing roller Fp is higher than that at the middle portion of the surface in the axial direction. Thus, when the continuous sheet S passes through the fixing region Q5, the continuous sheet S receives forces oriented in directions from the middle portion toward the end portions. If the continuous sheet S receives forces in directions from the end portions toward the middle portion, the continuous sheet S may crease and/or meander. In contrast, in the exemplary embodiment, creasing and meandering is reduced.

Description of Controller According to Exemplary Embodiment

Figure 8:
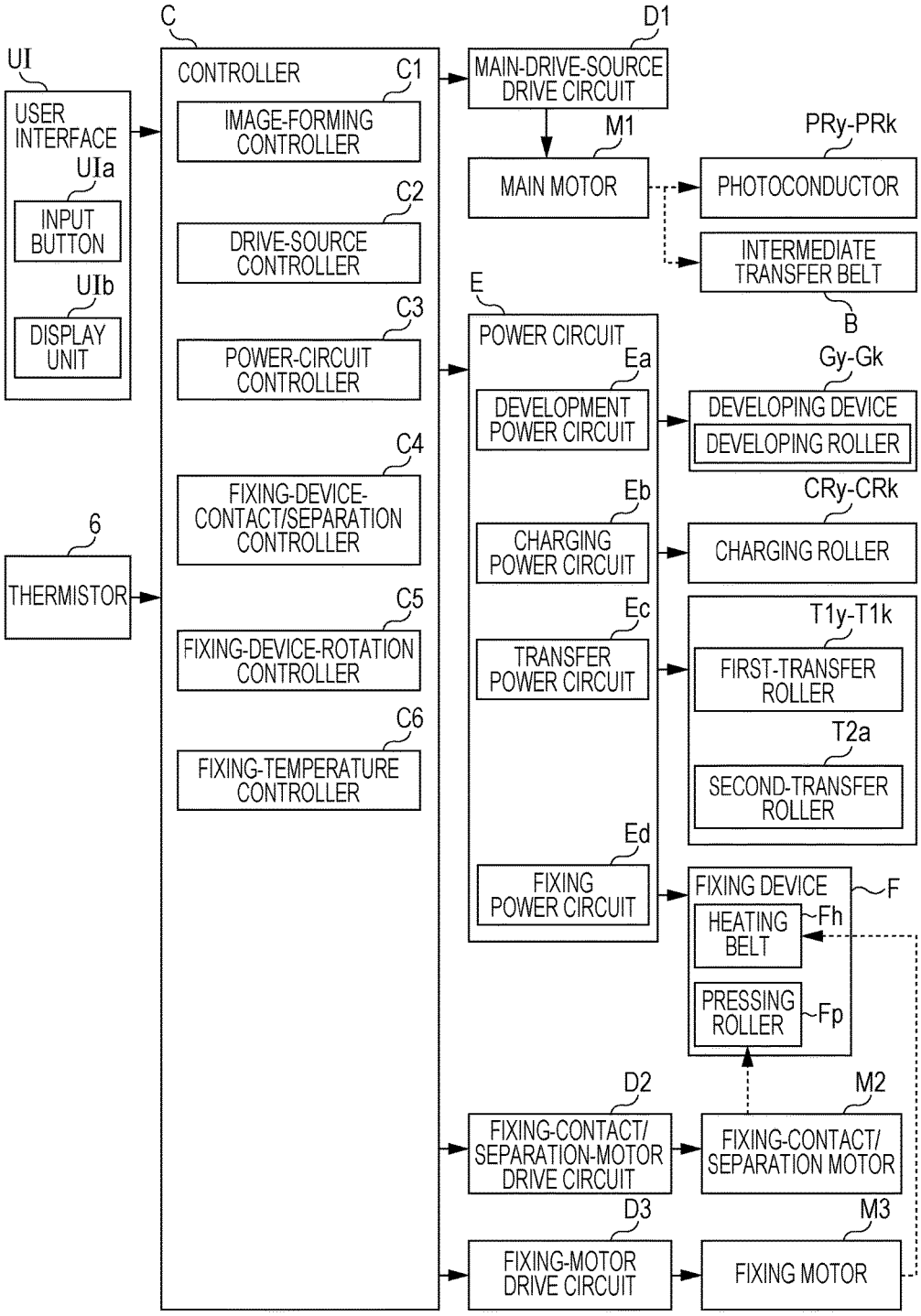
FIG. 8 is a block diagram illustrating functions of a controller of the image forming apparatus according to the exemplary embodiment.

FIG. 8 is a block diagram illustrating functions of the controller C of the image forming apparatus according to the exemplary embodiment.

Referring to FIG. 8, the controller C of the printer U includes an I/O interface for inputting signals from or outputting signals to external devices. The controller C includes a read-only memory (ROM) that stores programs, information, and the like for performing necessary processing. The controller C includes a random-access memory (RAM) for temporarily storing necessary data. The controller C includes a central processing unit (CPU) that performs processing in accordance with programs stored in the ROM and the like. Accordingly, the controller C according to the exemplary embodiment is a small information processing device (microcomputer). Thus, the controller C is capable of performing various functions by executing programs stored in the ROM and the like.

Signal Output Elements Connected to Controller C

Output signals from signal output elements, such as a user interface UI, the thermistor 6, and various sensors (not shown) are input to the controller C.

The user interface UI includes an input button UIa, which is an example of an input member and which is used to input an arrow, a number, or the like. The user interface UI includes a display UIb, which is an example of a notification member, and the like.

The thermistor 6 detects the temperature of the heating belt Fh.

Controlled Elements Connected to Controller C

The controller C is connected to a main-drive-source drive circuit D1, a fixing-contact/separation-motor drive circuit D2, a fixing-motor drive circuit D3, a power circuit E, and other controlled elements (not shown). The controller C outputs control signals to the circuits D1 to D3, E, and the like.

D1: Main-Drive-Source Drive Circuit

The main-drive-source drive circuit D1 drives a main motor M1, which is an example of a main drive source, to rotate the photoconductors PRy to PRk, the intermediate transfer belt B, and the like.

D2: Fixing-Contact/Separation-Motor Drive Circuit

The fixing-contact/separation-motor drive circuit D2 drives a fixing-contact/separation motor M2 to move the pressing roller Fp and the heating belt Fh to the contact position or the separated position.

D3: Fixing-Motor Drive Circuit

The fixing-motor drive circuit D3 drives a fixing motor M3 to rotate or stop the heating belt Fh.

E: Power Circuit

The power circuit E includes a development power circuit Ea, a charging power circuit Eb, a transfer power circuit Ec, a fixing power circuit Ed, and the like.

Ea: Development Power Circuit

The development power circuit Ea applies a development voltage to the developing rollers of the developing devices Gy to Gk.

Eb: Charging Power Circuit

The charging power circuit Eb applies a charging voltage, for charging the surfaces of the photoconductors PRy to PRk, to the charging rollers CRy to CRk.

Ec: Transfer Power Circuit

The transfer power circuit Ec applies a transfer voltage to the first-transfer rollers T1*y* to T1*k* and the backup roller T2*a*.

Ed: Fixing Power Circuit (Excitation Circuit)

The fixing power circuit Ed supplies electric power to the excitation coil 13 of the heating belt Fh of the fixing device F.

Functions of Controller C

The controller C has the function of performing processing in accordance with an input signal from each of the signal output elements and outputting a control signal to each of the controlled elements. That is, the controller C has the following functions.

C1: Image-Forming Controller

An image-forming controller C1 controls starting, stopping, and interrupting a job, which is an image forming operation, by controlling driving of members of the printer U and timings of applying voltages in accordance with image information input from the personal computer COM.

C2: Drive-Source Controller

A drive-source controller C2 controls driving of the main motor M1 via the main-drive-source drive circuit D1 and controls driving of the photoconductors PRy to PRk and the like.

C3: Power-Circuit Controller

A power-circuit controller C3 controls the power circuits Ea to Ed to control voltages applied to corresponding members and electric power supplied to the members.

C4: Fixing-Device-Contact/Separation Controller

A fixing-device-contact/separation controller C4 controls the fixing-contact/separation motor M2 via the fixing-contact/separation-motor drive circuit D2 to move the pressing roller Fp to the contact position or the separated position. The fixing-device-contact/separation controller C4 according to the exemplary embodiment moves the pressing roller Fp to the contact position when a job in started, the temperature of the heating belt Fh increases to a predetermined temperature (threshold), and transportation of the continuous sheet S is started. The fixing-device-contact/separation controller C4 according to the exemplary embodiment moves the pressing roller Fp to the separated position when the job is finished.

If the sheet width of the continuous sheet S is larger than a predetermined width (threshold), the fixing-device-contact/separation controller C4 according to the exemplary embodiment moves the eccentric cams 45 to large-size-stop positions where the fixing pressure is the maximum. If the sheet width is smaller than the threshold, the contact/separation controller C4 moves the eccentric cams 45 to small-size-stop positions where the fixing pressure is lower than that of the large-size-stop positions. These stop positions are determined beforehand by an experiment or the like.

C5: Fixing-Device-Rotation Controller

A fixing-device-rotation controller C5 controls the fixing motor M3 via the fixing-motor drive circuit D3 to rotate or to stop rotating the heating belt Fh. The fixing-device-rotation controller C5 according to the exemplary embodiment drives the heating belt Fh when a job is started, and stops driving the heating belt Fh when the temperature of the heating belt Fh increases to a predetermined temperature. The fixing-device-rotation controller C5 according to the exemplary embodiment drives the heating belt Fh when the job is finished and the pressing roller Fp separates from the heating belt Fh, and stops driving the heating belt Fh when a predetermined standby time (standby time) t1 elapses.

C6: Fixing-Temperature Controller

A fixing-temperature controller C6 controls supply of electricity to the excitation coil 13 via the fixing power circuit Ed to control the fixing temperature of the fixing region Q5. When a job is started, the fixing-temperature controller C6 according to the exemplary embodiment controls starting and stopping of supply of electricity to the excitation coil 13 so as to increase the temperature of the fixing region Q5 to a predetermined fixing temperature for performing the job and to maintain the fixing temperature during the job. When the job is finished, the fixing-temperature controller C6 according to the exemplary embodiment controls starting and stopping of supply of electricity to the excitation coil 13 so as to maintain the temperature of the fixing region Q5 at a standby temperature that is lower than the fixing temperature during the job until the standby time t1 elapses. For example, in the exemplary embodiment, the standby temperature is 120° C., and the fixing temperature during a job is 200° C.

Description of Flowchart of Exemplary Embodiment

Next, a control process of controlling the printer U according to the exemplary embodiment will be described with reference to a flowchart.

Description of Flowchart of Fixing Control Process

Figure 9:
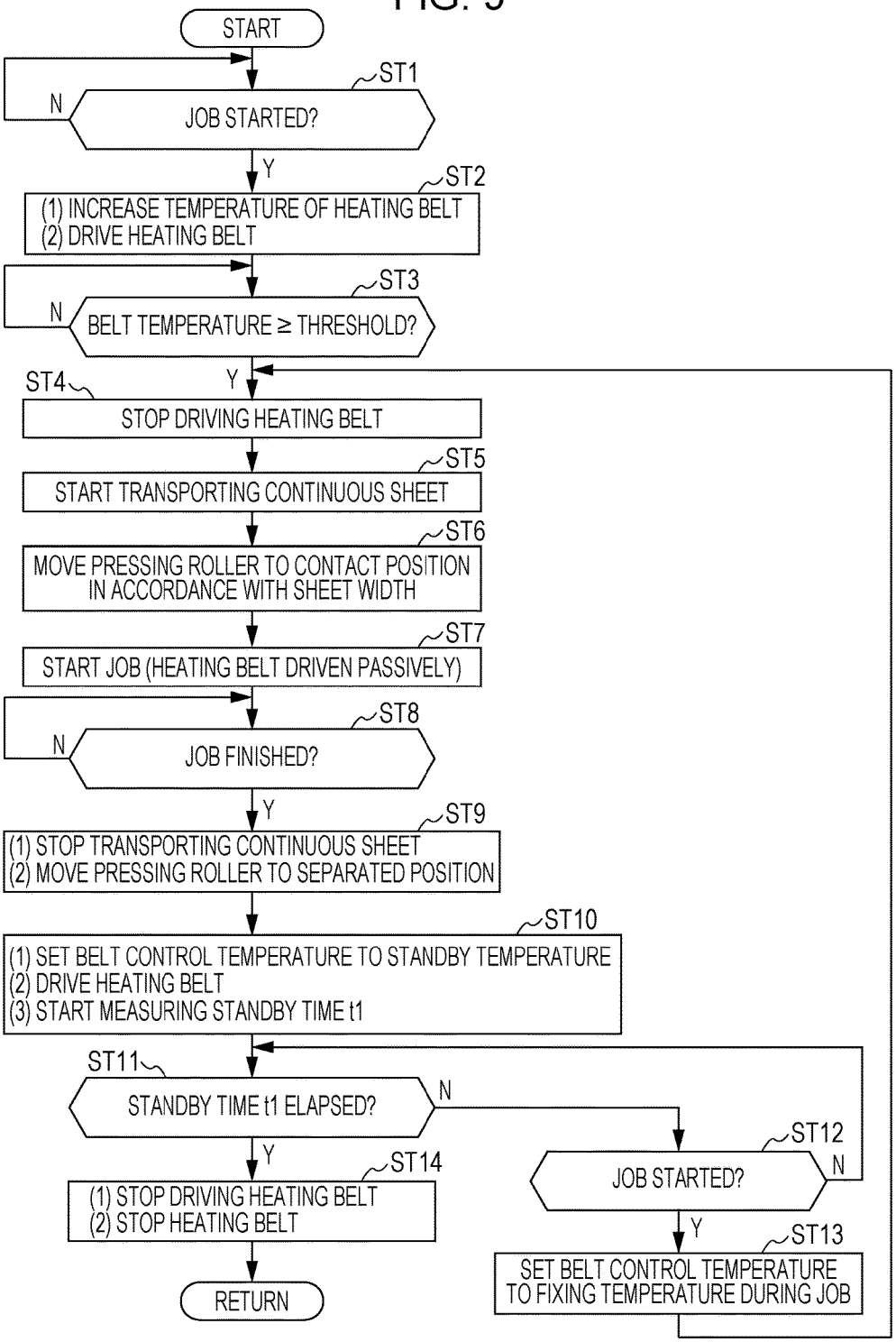
FIG. 9 is a flowchart of a fixing control process according to the exemplary embodiment.

FIG. 9 is a flowchart of a fixing control process according to the exemplary embodiment.

The process, including steps shown in FIG. 9, are performed in accordance with a program stored in the controller C of the printer U. This process is performed concurrently with other processes of the printer U.

The process shown in the flowchart of FIG. 9 is started when the power of the printer U is turned on.

In step ST1 of FIG. 9, whether a job is started is determined. If the determination is "yes" (Y), the process proceeds to step ST2. If the determination is "no" (N), step ST1 is repeated.

In step ST2, the following operations (1) and (2) are performed, and the process proceeds to step ST3.

(1) Increase the temperature of the heating belt Fh to a fixing temperature during a job.

(2) Start rotating the heating belt Fh.

In step ST3, whether the temperature of the heating belt Fh has increased a threshold (job-start temperature) is determined. If the determination is "yes" (Y), the process proceeds to step ST4. If the determination is "no" (N), step ST3 is repeated.

In step ST4, rotation of the heating belt Fh is stopped. Then, the process proceeds to step ST5.

In step ST5, transportation of the continuous sheet S is started. Then, the process proceeds to step ST6.

In step ST6, the pressing roller Fh is moved to a contact position in accordance with the sheet width. Then, the process proceeds to step ST7.

In step ST7, a job is started. During the job, the heating belt Fh and the pressing roller Fp are passively rotated in accordance with transportation of the continuous sheet S. Then, the process proceeds to step ST8.

In step ST8, whether the job has been finished is determined. If the determination is "yes" (Y), the process proceeds to step ST9. If the determination is "no" (N), step ST8 is repeated.

In step ST9, the following operations (1) and (2) are performed, and the process proceeds to step ST10.

(1) Stop transporting the continuous sheet S.

(2) Move the pressing roller Fp to the separated position.

In step ST10, the following operations (1) to (3) are performed, and the process proceeds to step ST11.

(1) Set the control temperature of the heating belt Fh to the standby temperature and start control so as to maintain the temperature of the heating belt Fh at the standby temperature.

(2) Start rotating the heating belt Fh.

(3) Start measuring the standby time t1.

In step ST11, whether the standby time t1 has elapsed is determined. If the determination is "no" (N), the process proceeds to step ST12. If the determination is "yes" (Y), the process proceeds to step ST14.

In step ST12, whether the next job is started is determined. If the determination is "yes" (Y), the process proceeds to step ST13. If the determination is "no" (N), the process returns to step ST11.

In step ST13, the control temperature of the heating belt Fh is set to the fixing temperature during a job. Then, the process returns to step ST4.

In step ST14, the following operations (1) and (2) are performed, and the process returns to step ST1.

(1) Stop rotating the heating belt Fh.

(2) Stop heating the heating belt Fh.

Operation of Exemplary Embodiment

With the printer U according to the exemplary embodiment having the structure describe above, when a job is started, the temperature of the heating belt Fh is increased to a temperature that allows the job to be started. At this time, the temperature is increased while rotating the heating belt Fh. While the heating belt Fh rotates, the pressing roller Fp is separated from the heating belt Fh.

When the temperature increases to the temperature that allows the job to be started, rotation of the heating belt Fh is stopped. Then, transportation of the continuous sheet S is started, and the pressing roller Fp contacts the continuous sheet S. During the job, the heating belt Fh and the pressing roller Fp are passively rotated by the continuous sheet S that is transported by the traction roller Rk. In the exemplary embodiment, even when the heating belt Fh is passively rotated, the one-way clutch 28*a* does not transmit the rotation to the fixing motor M3. Accordingly, breakage or the like of the fixing motor M3 is prevented.

After the job is finished, the heating belt Fh rotates while the temperature thereof is maintained at the standby temperature for the standby time t1. Accordingly, when the next job is started during the standby time t1, it is possible to perform the job promptly. In the exemplary embodiment, the standby temperature is set at a low temperature. In this case, compared with a case where the standby temperature is the same as the temperature during the job, deterioration (drying, partial melting, or the like) of the continuous sheet S due to radiant heat is reduced. In particular, in the exemplary embodiment, during the standby time, the pressing roller Fp is separated, and the continuous sheet S is easily separated from the heating belt Fh. Thus, compared with a case where the continuous sheet S is pressed in a standby state, deterioration of the continuous sheet S is reduced.

Thermal expansion or thermal contraction of the hating belt Fh and the pressing roller Fp occurs in accordance with the temperature of the fixing region Q5. With the existing technologies described in Japanese Unexamined Patent Application Publication No. 2016-180925 ([0053]-[0055], FIGS. 5 and 6) and Japanese Unexamined Patent Application Publication No. 2016-173420 ([0023], [0030]-[0032]), in which the fixing device F is driven, when the diameter increases due to thermal expansion, the transport speed of the continuous sheet S increases, tension of the continuous sheet S occurs between the fixing device F and the second-transfer roller T2*b* on the upstream side, and loosening of the continuous sheet S occurs between the fixing device F and the traction roller Rk on the downstream side. A problem of extension of a transferred image may occur if tension of the continuous sheet S occurs in the second-transfer region Q4, and a problem of a missing part of an image may occur if slipping between the continuous sheet S and the intermediate transfer belt B occurs. Moreover, if loosening of a part of the continuous sheet S occurs, a crease of the continuous sheet S may occur when the loosened part is nipped between the traction rollers Rk or nipped in the fixing region Q5.

For example, if the continuous sheet S is a thick sheet, when the heating belt Fh or the like thermally contacts due to absorption of heat by the continuous sheet S, loosening of the continuous sheet S may occur on the upstream side of the fixing device F, and a crease may occur in the fixing region Q5. If tension occurs on the downstream side of the fixing device F, slipping or the like may occur in the fixing region Q5, and an image defect such as a fixing failure or a nonuniform gloss may occur.

In particular, if the continuous sheet S is a thin sheet, thermal expansion of the pressing roller Fp is large. Even by reducing the transport speed of the pressing roller Fp if the continuous sheet S is a thin sheet, increase in the peripheral speed due to thermal expansion may not be properly handled. In this case, a problem occurs in that only a short job that will end before thermal expansion becomes large is allowed to be performed.

In contrast, with the fixing device F according to the exemplary embodiment, during a job, the heating belt Fh and the pressing roller Fp are passively rotated by the continuous sheet S. Accordingly, between the fixing region Q5 and the traction roller Rk or between the fixing region Q5 and the second-transfer region Q4, difference in the transport speed of the continuous sheet S does not occur. In particular, even when thermal expansion of the pressing roller Fp occurs, the speed of the continuous sheet S passing through the fixing region Q5 is stabilized at the transport speed of the traction roller Rk. Accordingly, occurrence of tension or loosening of the continuous sheet S is suppressed. Thus, compared with existing structures in which the fixing device F is driven, occurrence of an image defect, such as creasing or a fixing failure, is suppressed.

In the fixing device F according to the exemplary embodiment, the heating belt Fh is driven when increasing the temperature of the heating belt Fh before starting a job. That is, according to the exemplary embodiment, although the heating belt Fh is passively rotated during a job, the heating belt Fh is driven before starting the job and after the job has been finished. Compared with a case where the heating belt Fh is not driven when increasing the temperature of the heating belt Fh, nonuniformity in the temperature of the heating belt Fh along the entire periphery is reduced. Thus, compared with a case where nonuniformity in temperature occurs, occurrence of a fixing failure is suppressed. The rotation speed (peripheral speed) of the heating belt Fh may be set at any appropriate speed. Preferably, the rotation speed of the heating belt Fh is lower than the transport speed of the continuous sheet S during an image forming operation, because, in this case, heat is easily transferred to the entirety of the belt in the peripheral direction.

Moreover, in the fixing device F according to the exemplary embodiment, the pressing roller Fp is separated when the heating belt Fh rotates. Accordingly, compared with a case where the pressing roller Fp is in contact, the heat capacity of the entirety is small and the temperature increases in a short time to a level that allows a job to be started. Moreover, compared with the case where the pressing roller Fp is in contact, rotational load on the heating belt Fh is reduced. Thus, it is possible to use an inexpensive and small motor as the fixing motor M3.

In the exemplary embodiment, the heating belt Fh, which is not a roller but a belt, is used as an example of a first fixing member. In a case where a heating roller is used, generally, it is necessary to increase the contact pressure in order to increase the contact area in the fixing region Q5, compared with case where a heating belt is used. When the contact pressure increases, rotational resistance and rotational load increase, and transport load when the traction roller Rk transports the continuous sheet S increases. Because the heating belt Fh is used in the exemplary embodiment, transport resistance of transporting the continuous sheet S is reduced, compared with the case where a heating roller is used.

Moreover, in the exemplary embodiment, the contact pressure of the pressing roller Fp is changed in accordance with the sheet width, and the contact pressure is set high when the sheet width is large. When the sheet width is small, the area over which the pressing roller Fp directly contacts the heating belt Fh is large, and thermal expansion tends to occur. In particular, in the exemplary embodiment, the pressing roller Fp has a flared shape in order to prevent creasing or meandering, and thermal expansion tends to influence considerably at the end portions in the axial direction, where the outside diameter is large. Then, due to thermal expansion, the contact pressure in the fixing region Q5 increases. Thus, even if the fixing pressure generated by the operation of the eccentric cams 45 is low, a pressure necessary for a fixing operation is easily obtained with the increase in pressure due to thermal expansion. Moreover, a fixing pressure necessary for passive rotation is easily obtained, and the rotation of the pressing roller Fp is easily stabilized. On the other hand, even when the sheet width is small, if the eccentric cams 45 are stopped at positions that are the same as those of a case where the sheet width is large, the fixing pressure becomes excessively high and transport resistance may become excessively large. Accordingly, in the exemplary embodiment, the position of the pressing roller Fp is controlled in accordance with the sheet width, and the rotation of the pressing roller Fp is easily stabilized.

Modifications

The present invention is not limited to the exemplary embodiment described above, which may be modified in various ways within the spirit and scope of the present invention described in the claims. Modifications (H01) to (H011) according to the present invention are as follows.

(H01) In the exemplary embodiment, the printer U is described as an example of an image forming apparatus. However, this is not a limitation. For example, an image forming apparatus according to the present invention may be a copier, a fax, or a multifunctional machine having all or some of the functions of these.

(H02) In the exemplary embodiment, four-color developers are used in the printer U. However, this is not a limitation. For example, the present invention is applicable to a single-color image forming apparatus and a multiple-color (three-or-less or five-or-more color) image forming apparatus.

(H03) In the exemplary embodiment, the heating belt Fh and the pressing roller Fp are described as examples of a fixing member. However, this is not a limitation. For example, both of the fixing members may have belt-like shapes. Both of the fixing members may have roll-like shapes if it is not necessary to take transport resistance into consideration. A heating roller may be used as a first fixing member, and a pressing belt may be used as a second fixing member.

(H04) In the exemplary embodiment, the induction heating unit 11 is used as a heat source for heating the heating belt Fh. However, this is not a limitation. Heating may be performed by using a heater, which is an example of a heat source.

(H05) In the exemplary embodiment, preferably, the heating belt Fh and the pressing roller Fp are separated from each other when moved to the separated position. However, this is not a limitation. At the separated position, the heating belt Fh and the pressing roller Fp need not be completely separated from each other, and may be in contact with each other with a low contact pressure.

(H06) In the exemplary embodiment, preferably, the heating belt Fh is rotated when increasing temperature before starting a job. However, temperature may be increased without rotating the fixing belt Fh. In this case, preferably, the pressing roller Fp is heated in a separated state. However, the pressing roller Fp may be heated in a contact state.

(H07) In the exemplary embodiment, a mechanism for moving the pressing roller Fp is not limited to the mechanism described above. For example, the pressing roller Fp may be moved by using a solenoid, which is an example of an operation member, or via a lever, a link, or the like. Although the pressing roller Fp is preferably moved, the heating belt Fh may be moved, or, for example, both of the pressing roller Fp and the heating belt Fh may be moved in directions such that the pressing roller Fp and the heating roller Fh become closer to or away from each other.

(H08) In the exemplary embodiment, preferably, the pressing roller Fp and the heating belt Fh are configured to contact or separate. However, the pressing roller Fp and the heating belt Fh may be inseparable and continue to be in contact with each other.

(H09) In the exemplary embodiment, the order of stopping rotation the heating belt Fh, starting transportation of the continuous sheet S, and causing the pressing roller Fp to contact is not limited to the order described in the exemplary embodiment. These operations may be performed simultaneously. For example, before stopping rotation of the heating belt Fh, transportation of the continuous sheet S may be started, and the pressing roller Fp may be caused to contact in a state in which the relative rotation speed of the heating belt Fh and the continuous sheet S is reduced. This is preferable because occurrence of scratching is suppressed.

(H010) In the exemplary embodiment, preferably, the pressing roller Fp has a flared shape. However, this is not a limitation. The pressing roller Fp may have a uniform diameter in the axial direction or a roller-like shape having a larger diameter at a middle portion thereof in the axial direction (so-called crown shape or a barrel shape).

(H011) In the exemplary embodiment, preferably, a contact position moved by the eccentric cams 45 is adjusted in accordance with the width of the continuous sheet S. However, the contact position may be a fixed position.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a transfer member configured to transfer an image on the image carrier to a continuous medium;

a fixing device configured to fix the image transferred to the medium; and a transport member disposed downstream of the fixing device in a transport direction of the medium and configured to transport the medium, wherein the fixing device comprises:

a first fixing member having an endless shape; and a second fixing member having a substantially cylindrical shape; and wherein, when the transport member transports the medium, the first and the second fixing members are passively rotated in accordance with movement of the medium.

2. The image forming apparatus according to claim 1, wherein the fixing device includes the first fixing member and the second fixing member that face each other with the medium therebetween and a heat source that heats the first fixing member, and wherein, after finishing a fixing operation of fixing the image to the medium, the first fixing member and the second fixing member are separated from each other, and then the first fixing member is rotated in a state in which a temperature of the first fixing member is lower than a temperature of the first fixing member during the fixing operation.

3. The image forming apparatus according to claim 1, wherein the fixing device includes the first fixing member and the second fixing member that face each other with the medium therebetween, and wherein, in a case where a width of the continuous medium is large, a pressure with which the first fixing member and the second fixing member contact each other is increased compared with a case where the width is small.

4. The image forming apparatus according to claim 3, wherein at least one of the first fixing member and the second fixing member has a shape such that a diameter thereof increases outward in a width direction of the medium.

5. An image forming apparatus comprising:

an image carrier;

a transfer member configured to transfer an image on the image carrier to a continuous medium;

a fixing device configured to fix the image transferred to the medium;

a transport member disposed downstream of the fixing device in a transport direction of the medium and configured to transport the medium; and a controller configured to control the transfer member, the fixing device and the transport member, wherein, when the transport member transports the medium, the fixing device is passively rotated in accordance with movement of the medium, and wherein, before performing a fixing operation of fixing the image to the medium, a heating operation of increasing a temperature of at least a part of the fixing device to a predetermined fixing temperature is performed while driving the fixing device.

6. The image forming apparatus according to claim 5, wherein the fixing device comprises:

a first fixing member; and a second fixing member, the first and second fixing members facing each other with the medium therebetween, and wherein the heating operation is performed in a state in which the first fixing member and the second fixing member are separated from each other.

7. The image forming apparatus according to claim 6, wherein the first fixing member is heated by a heat source, and wherein the heating operation is performed while rotating the first fixing member.

8. An image forming apparatus comprising:

an image carrier;

a transfer member configured to transfer an image on the image carrier to a continuous medium;

a fixing device configured to fix the image transferred to the medium; and a transport member disposed downstream of the fixing device in a transport direction of the medium and configured to transport the medium, wherein the fixing device comprises:

a first fixing member; and a second fixing member, wherein the first fixing member and the second fixing member face each other with the medium therebetween, and wherein, when the first fixing member and the second fixing member contact each other and when the transport member transports the medium, the first and the second fixing members are passively rotated in accordance with movement of the medium.

* * * * *